United States Patent [19]

Tonon et al.

[11] Patent Number: 4,588,373

[45] Date of Patent: May 13, 1986

[54] CATALYTIC CAMPING STOVE

[75] Inventors: Thomas Tonon, Princeton, N.J.; Claudio Bruno, Milan, Italy; Michael D. Leshner, Columbia, Md.

[73] Assignee: David Landau, Arlington, Va.

[21] Appl. No.: 779,302

[22] Filed: Sep. 23, 1985

Related U.S. Application Data

[63] Continuation of Ser. No. 627,433, Jul. 3, 1984, abandoned.

[51] Int. Cl.[4] ..... F23D 14/12

[52] U.S. Cl. ..... 431/328; 431/344; 431/268; 126/39 J

[58] Field of Search ..... 126/39 F, 39 R, 39 N, 126/38, 9 R, 39 J, 91 R, 92 AC; 431/344, DIG. 1, 268, 326, 328

[56] References Cited

U.S. PATENT DOCUMENTS

| | | | |
|---|---|---|---|
| 1,502,807 | 7/1924 | Berger | 431/268 X |
| 1,956,749 | 5/1934 | Terret | 431/268 X |
| 2,825,325 | 3/1958 | Ross | 431/344 X |
| 3,067,811 | 12/1962 | Webster | 126/39 J |
| 3,245,459 | 4/1966 | Keith | 431/268 X |
| 3,648,680 | 3/1972 | Hein | 126/38 |
| 3,900,281 | 8/1975 | Penberthy | 431/344 |
| 4,082,993 | 4/1978 | Oake | 431/344 X |
| 4,189,294 | 2/1980 | Rice et al. | 126/39 J X |

FOREIGN PATENT DOCUMENTS

| | | | |
|---|---|---|---|
| 516074 | 12/1930 | Fed. Rep. of Germany | 431/328 |
| 87517 | 6/1982 | Japan | 431/328 |
| 28914 | 2/1983 | Japan | 431/268 |

*Primary Examiner*—Randall L. Green

*Attorney, Agent, or Firm*—Kane, Dalsimer, Kane, Sullivan and Kurucz

[57] ABSTRACT

A catalytic stove is provided comprising a mixing chamber having one end adapted to receive a fuel can and an opposite end provided with a diffuser. A plate provided with a grid of between 200 and 400 openings per square inch extends across the exit end of the diffuser. A catalytic surface is coated on the exit portion of the plate. The catalyst is selected from the group consisting of platinum, palladium, rhodium and iridium.

9 Claims, 4 Drawing Figures

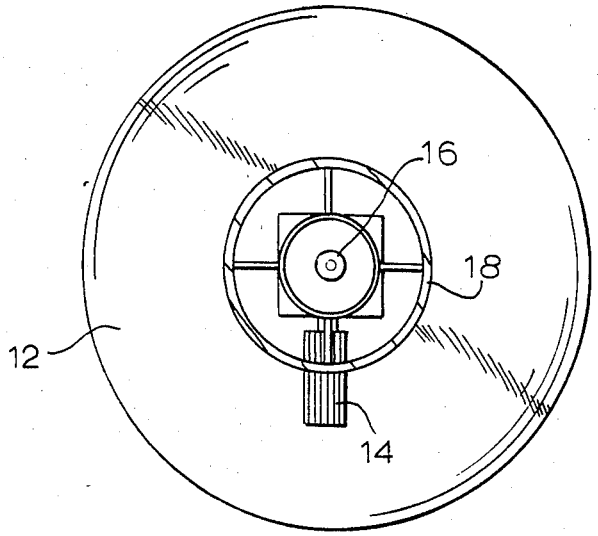
FIG.2
FIG.3
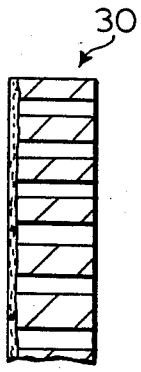
FIG.4
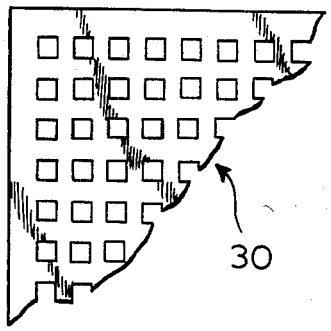

CATALYTIC CAMPING STOVE

This is a continuation of co-pending application Ser. No. 627,433 filed on July 3, 1984, now abandoned.

BACKGROUND OF THE INVENTION

The present invention relates to camping stoves and in particular to flame-free, catalytic stoves.

The conventional camping stove of the type designed to fit in a backpack or the like consists of a burner unit adapted to screw or clamp onto a can containing a supply of fuel such as propane or butane. While such stoves meet the prime objectives of being light-weight and hence easily portable, they suffer from the serious drawback of relying on an open flame to product heat. The flame poses a fire hazard particularly when used in a dry location. In addition, the flame is subject to being extinguished, or the heat therefrom to being dispersed during windy or rain conditions. A furthr problem with such stoves is that they permit only a limited degree of throttling and hence, must burn at substantially the same rate in all conditions.

In view of the above, it is the principal object of the present invention to provide an improved camping stove which is less sensitive to weather conditions than conventional, flame type stoves.

A further object is to provide such a stove which may more readily be throttled as required to increase or decrease the rate of combustion.

Still further objects are to provide a camping stove which is more fuel efficient than conventional stoves and which yields less objectionable emissions than conventional stoves.

SUMMARY OF THE INVENTION

The above and other beneficial objects and advantages are attached in accordance with the present invention by providing a camp stove comprising an elongated fuel-air mixing chamber in the form of an elongated tube. A fuel tank coupling is provided at the inlet of the chamber. A diffuser is provided surrounding the output of the chamber. A plate provided with a grid overlies the outlet end of the diffuser. The plate is a monolithic mettalic or ceramic member with between 200 and 400 openings per inch therein, the openings being on the order of 0.06"×0.06" and 0.044"×0.044", respectively. The plate has an exit face with a catalytic coating thereon extending minutely into the interstices of the grid. The catalytic coating is formed from the gorup consisting of platinum, palladium, rhodium and iridium.

BRIEF DESCRIPTION OF THE DRAWINGS

In the accompanying drawings:

FIG. 2 is a sectional view taken along reference line 2—2 of fIG. 1 in the direction indicated by the arrows;

FIG. 3 is a simplified enlarged side elevational view of the stove plate; and, FIG. 4 is a fragmentary enlarged schematic plan view of the plate grid.

DETAILED DESCRIPTION OF THE PREFERRED EMBODIMENT

Figure 1:
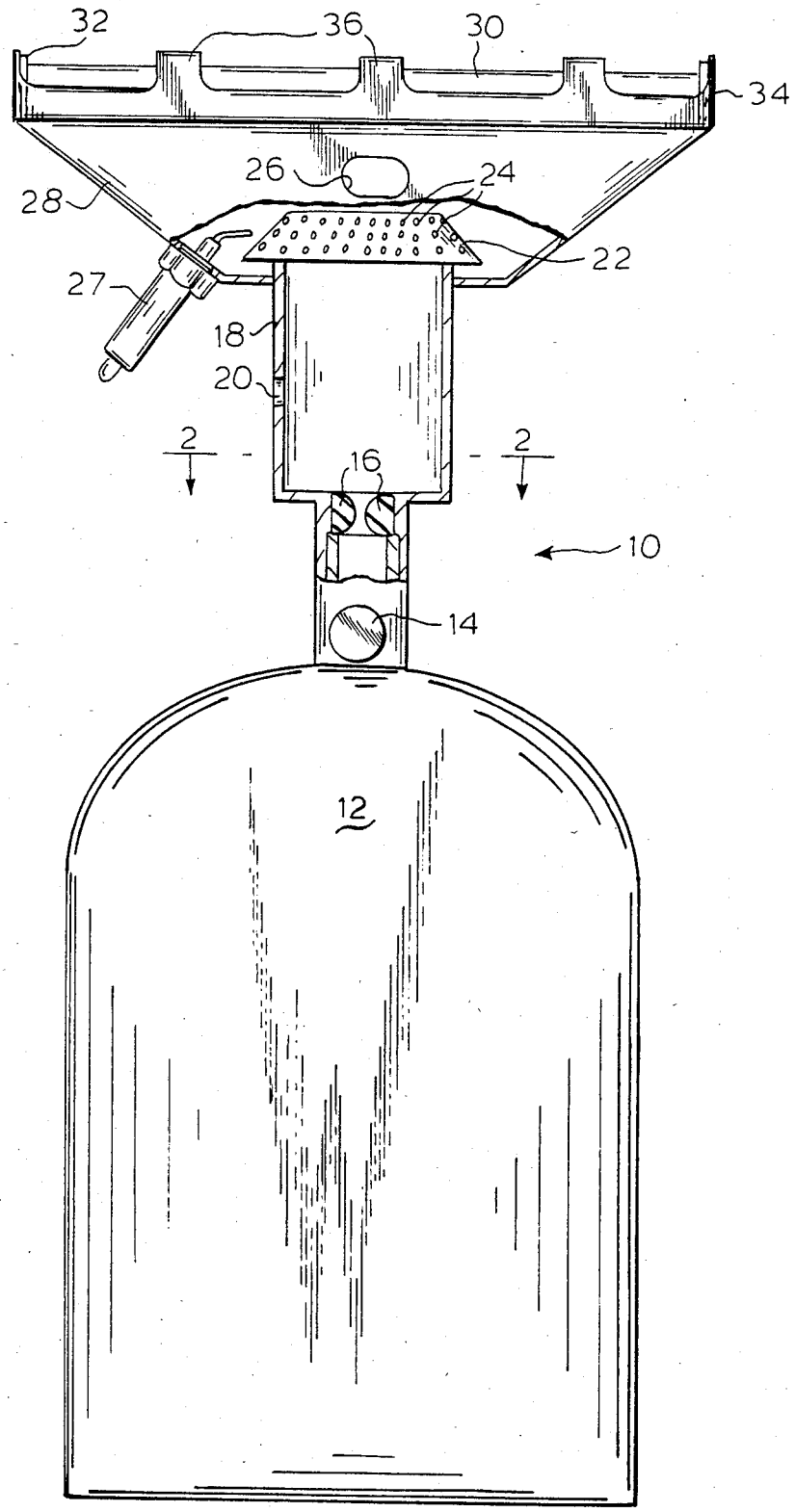
FIG. 1 is a simplified side elevational sectional view of a catalytic stove in accordance with the present invention.

Reference is now made to the drawings and to FIG. 1 in particular wherein a stove 10 in accordance with the present invention is depicted. The stove is designed to be used with a conventional fuel can or tank 12 containing liquid butane or propane. To this end, the top of tank 12 contains a coupling for connection to a mating coupling provided at the bottom of the stove. A valve 14 is provided at the inlet to the stove for regulating the flow of fuel from the tank into the stove.

The stove includes a mixing chamber in the form of an elongated tube 18.

An orifice 16 is provided at the inlet to the mixing tube 18 which comprises the main body of stove 10. The orifice is fixed and serves to regulate the flow of fuel from tank 12 when valve 14 is open. The orifice produces a high velocity jet of fuel which enters into tube 18. Ambient air which enters the tube 8 through an inlet opening 20 is sucked into the tube where it is mixed with the gas to form a combustible mixture. The relative sizes of the orifice and tube determine the resulting ratio of air to fuel passing through the stove.

At the top end of tube 18 a flame holder 22 in the form of a perforated truncated cone is provided. The flame holder 22 serves as a cap for the tube so that the perforations 24 extending through the cap provide the only exit for the fuel/air mixture passing through the tube. As shown, the perforations 24 are distributed substantially uniformly over the flame holder surface.

An ignition port 26 extends through the flame holder 22. A spark igniter 27, utilizing, for example, a flint or piezoelectric element may be provided in a ignition port in the manner common in conventional gas stoves.

A diffuser 28 comprising an inverted, truncated cone extends upwardly from the side of tube 18 adjacent to its upper end. As shown, the ignition port 28 passes through the diffuser. The bottom of diffuser 28 is sealed to the outer surface of tube 18 so that the diffuser 28 acts as a funnel directing the gas/air mixture upwardly and outwardly. A plate 30 is provided extending across the open top end of the diffuser 28. A gasket 32 seals the edge of plate 30 to a rim 32 which, in turn, is sealed to or formed integral with the top edge of the diffuser. Rim 34 is provided with spaced projections 36 that extend beyond the top face of plate 30. These projections serve as a support for pots or pans to be heated on the stove. The plate 30 is shown in some detail in FIGS. 3 and 4. As shown, the plate is a generally pancake-shaped member which may be formed of a ceramic or metal. The plate is formed as a monolith with a relatively large number of small openings extending therethrough. The number of openings should be on the order of 200–400 per square inch.

An important aspect of the present invention resides in the fact that a catalytic surface is applied as a coating to the outer (i.e. exit) face of plate 30 extending into the interstices of the grid to a depth of approximately 1 or 2 mm. This depth is such as to complete combustion of the fuel/air mixture in the presence of the catalyst. The catalyst is applied only as a surface coating to plate 30. The catalyst may be platinum, palladium, or other rare metal such as rhodium or iridium.

In operation, the valve is first opened to permit fuel to flow from the tank through the orifice into the mixing tube.

As the gas passes through the tube it entrains air thereby creating a flammable mixture. The spark igniter is then activated or a flame is passed through the ignition port to ignite the gas/air mixture at the top of the flame holder. After several seconds the catalyst is heated and the flame is extinguished by turning off the gas flow. The valve is then reopened to re-establish gas flow and after a few seconds the top portion of the plate 30 glows from the catalytic combustion that is taking place. Food may then be cooked or water boiled by placing a pan on the pot/pan supports 36. Heating takes place by means of radiant heating and by convection of the heated gases passing adjacent to the cooking utensil. Since the present stove operates without a flame, it is less sensitive to wind than are conventional flame stoves. In addition, the catalytic stove throttles better than conventional stoves since there is no need to support a flame.

Thus, in accordance with the above, the aforementioned objectives are effectively attained.

Having thus described the invention, what is claimed is:

1. A catalytic stove comprising:

a fuel/air mixing chamber for generating a fuel/air mixture and having an inlet and an outlet;

A diffuser surrounding the chamber outlet;

a plate overlying the diffuser, said plate having an inner face, an exit face opposed to and spaced away from said inner face and a grid of openings interconnecting said faces for passing the fuel/air mixture from the mixing chamber; preheating means for preheating said plate;

said inner face being directed toward said chamber; and said exit face directed away from said chamber, said plate being provided with a catalytic coating only on said exit face and extending minutely into the openings as compared to the overall length of the grid for generating flameless heat by catalytic combustion of the fuel/air mixture substantiallay at said exit face only without directly heating the inner face due to the thickness of the plate.

2. The stove in accordance with claim 1 wherein said preheating means comprises a flame holder disposed about said chamber outlet and positioned within said diffuser.

3. The stove in accordance with claim 2 wherein said diffuser comprises a truncated, inverted cone and said flame holder comprises a truncated perforated cone.

4. The stove in accordance with claim 1 further comprising fuel receiving means at the chamber inlet;

an orifice upstream of said fuel receiving means to accelerate the flow of fuel through said chamber; and, an air inlet passing through said chamber whereby fuel passing through said chamber entrains air from within said chamber.

5. The stove in accordance with claim 2 wherein said preheating means further comprises fuel/air igniter means in said chamber aligned with said flame holder for causing initial combustion of the fuel/air mixture exiting said flame holder for preheating said catalytic coating on said plate, thereafter combustion occurring only at said plate by the catalyst.

6. The stove in accordance with claim 1 wherein said diffuser further comprises a pan support extending about said plate grid, said support including support surfaces extending outwardly beyond the exit face of said plate.

7. The stove in accordance with claim 1 wherein said plate comprises a monolithic member provided with between 200 and 400 openings per square inch.

8. The stove in accordance with claim 1 wherein said catalytic coating is selected from the group consisting of platinum, palladium, rhodium and iridium.

9. The stove in accordance with claim 1 wherein said catalytic coating extends to a depth of 1 or 2 mm.

* * * * *

UNITED STATES PATENT AND TRADEMARK OFFICE

CERTIFICATE OF CORRECTION

PATENT NO. : 4,588,373

DATED : May 13, 1986

INVENTOR(S) : Thomas Tonon, Claudio Bruno, D. Leshner

It is certified that error appears in the above-identified patent and that said Letters Patent is hereby corrected as shown below:

Column 1, line 16, 'product' should be 'produce'.

Column 1, line 20, 'furthr' should be 'further'.

Column 1, line 37, 'attached' should be 'attained'.

Column 1, line 50, 'gorup' should be 'group'.

Column 1, line 59, 'fIG.' should be 'FIG.'.

Column 2, line 15, 'tube 8' should be 'tube 18'.

Claim 1, column 3, line 18, 'substantiallay' should be 'substantially'.

Signed and Sealed this

*Ninth* Day of *September 1986*

[SEAL]

*Attest:*

DONALD J. QUIGG

*Attesting Officer*

*Commissioner of Patents and Trademarks*